United States Patent [19]

Hernandez

[11] 3,939,546

[45] Feb. 24, 1976

[54] TOOL FOR SETTING JOINTED FLOORING PANELS

[76] Inventor: Ralph G. Hernandez, 4070 Huerfano Ave., San Diego, Calif. 92117

[22] Filed: Aug. 7, 1974

[21] Appl. No.: 495,438

[52] U.S. Cl. ..... 29/278; 254/11

[51] Int. Cl.[2] ..... B25B 27/02

[58] Field of Search ..... 29/270, 278; 254/11, 15, 254/17; 15/235.4, 235.8

[56] References Cited

UNITED STATES PATENTS

| | | | |
|---|---|---|---|
| 876,693 | 1/1908 | Coldwell | 254/15 |
| 1,021,557 | 3/1912 | Runner | 15/235.8 |
| 1,797,484 | 3/1931 | Smith | 15/235.4 |
| 2,410,343 | 10/1946 | Haivala | 15/235.6 |
| 3,082,460 | 3/1963 | Haivala | 15/235.8 |
| 3,090,066 | 5/1963 | Ferrell, Jr. et al. | 15/235.8 |

*Primary Examiner*—Al Lawrence Smith
*Assistant Examiner*—Harold P. Smith, Jr.
*Attorney, Agent, or Firm*—Ralph G. Hernandez

[57] ABSTRACT

The invention is a tool for setting jointed flooring boards, particularly of the tongue-and-groove type, having a bracket of L-shaped cross section to which a length of construction lumber is removably attached by screws. A long handle is rigidly and adjustably attached to the bracket and the user grips the handle to slide the length of lumber back and forth across the floor joists to drive a flooring panel into engagement with a mating floor panel.

1 Claim, 3 Drawing Figures

TOOL FOR SETTING JOINTED FLOORING PANELS

BACKGROUND OF THE INVENTION

Modern flooring for buildings, particularly residences, is often constructed of four by eight foot tongue and groove plywood panels laid on parallel joists. When the flooring is being laid each succeeding panel must be driven into engagement with the preceeding panel with considerable force to securely engage the tongue in the groove. This has been accomplished in the past by a team of two workmen, one of whom stands over the mating edges of the boards and guides the driven board into place, while the other stands on the driven board and drives same with a sledge hammer applied against a 2 × 4 placed along the outer edge of the panel.

This proceedure has several drawbacks, among them being the need for two men to do the job. Considerable risk of injury to the workers also exists since occasionally the sledge misses its marks and flies into the worker acting as the guide, and the hammer-wielding worker is in danger of falling through the joists and incurring severe injury when a second story floor is being laid.

SUMMARY OF THE INVENTION

The present invention is a tool which can be used by a single workman to set floor panels in a manner that all but eliminates the hazard associated with the proceedure. An elongated bracket of L-shaped cross section is provided with a plurality of screw holes through which a 2 × 6 board can be screw-mounted, and a long handle is mounted to the bracket and extends upwardly at an angle over the free edge of the board. The operator grips the handle and repeatedly slides the board over the floor joists forceably into contact with the panel to be set, and simultaneously, by standing over the mating edges of the panels, guides them into proper engagement with his feet. Because of the position assumed by the workman, there is little likelihood of falling between joists and virtually no possibility that the tool itself could produce injury. The handle is adjustably mounted to the bracket and can be made to assume various angles with the operating plane of the board to accomodate variations in the height of the operator.

DETAILED DESCRIPTION OF THE PREFERRED EMBODIMENT

The tool is used in setting jointed flooring boards or panels, often 4 × 8 tongue and groove plywood panels, on fairly closely spaced parallel joists 10. Each succeeding panel 12 must be guided into engagement with the last previously set panel 14 and driven against it with considerable force to form a tight tongue and groove joint.

Figure 1:
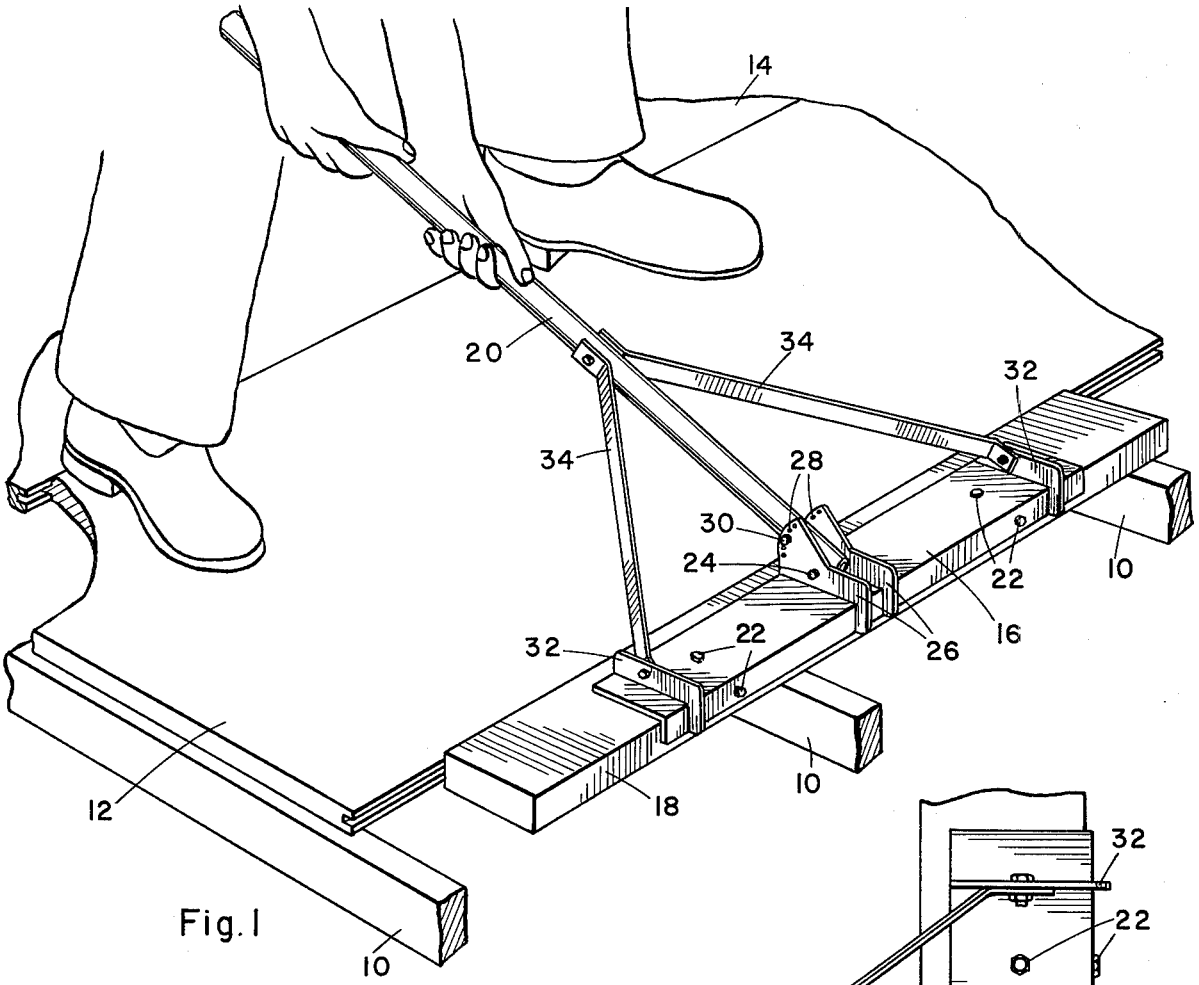
FIG. 1 is a perspective view showing the tool in use.
Figure 2:
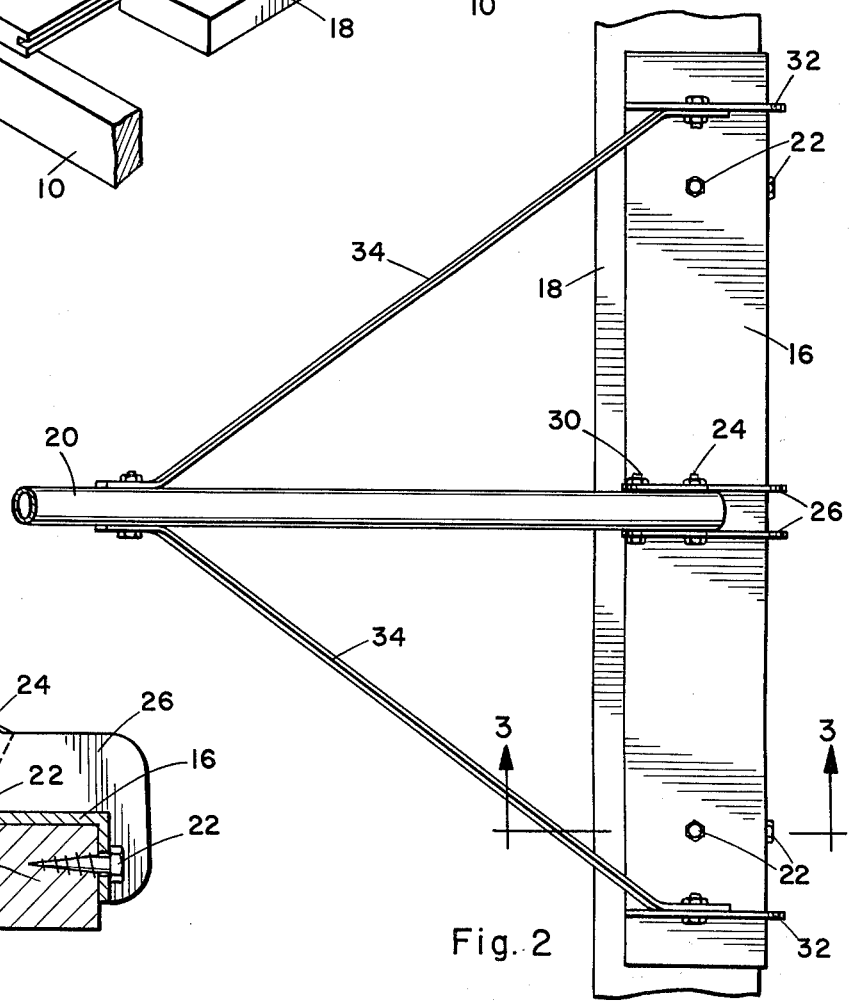
FIG. 2 is an enlarged top plan view of the tool.
Figure 3:
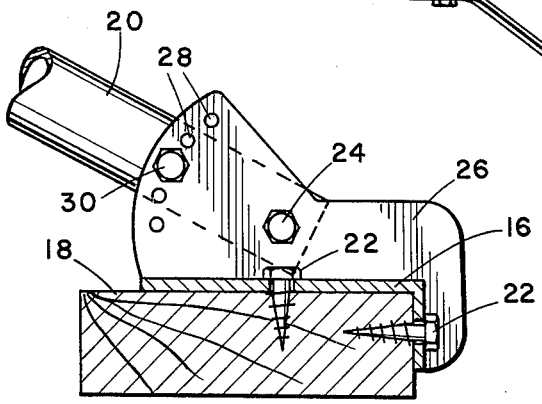
FIG. 3 is an enlarged sectional view taken on line 3—3 of FIG. 2.

The tool provided to set the panels comprises a bracket 16 to which is mounted a board 18, and a long tubular handle 20 mounted to the bracket such that a workman can stand at the panel junction holding the handle as shown in FIG. 1 and slide the board back and forth on the joists to forceably drive the panels together.

The bracket 16 may be made in a variety of different shapes but the simple L-shaped configuration shown permits secure attachment to the board such that the upper trailing edge is gripped. The means of attaching the board to the bracket comprises screws 22 which engage the board through several hole provided at various places in the bracket. Clearly nails, other types of fasteners, or even releasible clamps could be utilized to mount the board, the only requirement, beyond leaving the bottom and driving surfaces of the board free, being that the board must be fairly easily removable and replaceable. This is due to the fact that as conceived the board will be a length of scrap 2 × 6 and will take sufficient abuse if used continously to require replacement as often as once a day to prevent the leading surface from becoming ragged and marring the mating surface of the flooring panel.

The handle 20 could simply be welded or otherwise rigidly attached to the bracket, but for obvious reasons adjustability is desireable and to this end the handle 20, which may be a metal tube or pipe, is pivoted at 24 to and between two parallel flanges, such that a bolt 30 or the like can be used to lock the handle between the flanges at any of several angles relative to the operating plane of the tool.

The flanges are L-shaped at their trailing ends and double as reinforcing ribs for the bracket, and a second pair of reinforcing ribs 32 is provided near the outer ends of the bracket. A pair of braces 34 are rigidly secured to the handle and pivotably connected to the ribs 32 to permit adjustment of the handle.

I claim:

1. A tool for setting jointed flooring panels by impact comprising:

a. a bracket of generally L-shaped lateral cross section;

b. an elongated length of lumber having a flat leading edge and a flat trailing edge, said length of lumber being mounted in said L-shaped bracket such that one of the angulated portions thereof engages the trailing edge of said length of lumber;

c. a plurality of generally L-shaped support ribs longitudinally spaced along and mounted to said L-shaped bracket, two of said ribs being located generally centrally of said bracket;

d. an elongated handle having one end rigidly mounted to and between said centrally located ribs and extending at an angle over the trailing edge of said board and in a plane perpendicular to the length of said board;

e. two angulated braces extending from said handle in generally opposite direction to respective ones of said ribs, whereby three point direct support is provided between said handle and the trailing edge of said length of lumber to reinforce same on impact during use.

* * * * *